US011840425B2

(12) United States Patent
Geisshüsler et al.

(10) Patent No.: US 11,840,425 B2
(45) Date of Patent: Dec. 12, 2023

(54) SAFETY BRAKE FOR AN ELEVATOR

(71) Applicant: Inventio AG, Hergiswil (CH)

(72) Inventors: Michael Geisshüsler, Sursee (CH); Faruk Osmanbasic, Sins (CH); Adrian Steiner, Inwil (CH); Julian Stähli, Meggen (CH); Volker Zapf, Kriens-Obernau (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/757,149

(22) PCT Filed: Dec. 11, 2020

(86) PCT No.: PCT/EP2020/085811
§ 371 (c)(1),
(2) Date: Jun. 10, 2022

(87) PCT Pub. No.: WO2021/122385
PCT Pub. Date: Jun. 24, 2021

(65) Prior Publication Data

US 2022/0356044 A1 Nov. 10, 2022

(30) Foreign Application Priority Data

Dec. 17, 2019 (EP) ..... 19217111

(51) Int. Cl.
*B66B 5/22* (2006.01)

(52) U.S. Cl.
CPC ..... *B66B 5/22* (2013.01)

(58) Field of Classification Search
CPC ..... B66B 5/16; B66B 5/18; B66B 5/22
See application file for complete search history.

(56) References Cited

U.S. PATENT DOCUMENTS 6,003,636 A * 12/1999 Yumura ..... B66B 5/22 188/189
6,092,630 A * 7/2000 Wendel ..... B66B 5/20 187/373
6,293,376 B1 * 9/2001 Pribonic ..... B60L 7/28 187/361

(Continued)

FOREIGN PATENT DOCUMENTS

DE 19616344 A1 * 11/1997 ..... B66B 5/04
EP 0812796 A1 12/1997

(Continued)

*Primary Examiner* — Michael A Riegelman
(74) *Attorney, Agent, or Firm* — William J. Clemens; Shumaker, Loop & Kendrick, LLP

(57) ABSTRACT

A safety brake includes a first brake element, a first guide element, and an actuating element. The first brake element is mounted in a displaceable manner in a linear bearing on the first guide element. The first guide element can be moved between a rest position and a braking initial position. The actuating element is designed to move the first guide element from the rest position into the braking initial position, more particularly to activate the safety brake. The first brake element can carry out a braking movement from the braking initial position into a braking position. The braking movement returns the first guide element to the rest position. The first guide element is guided on a first parallelogram guide.

17 Claims, 6 Drawing Sheets

(56) References Cited

U.S. PATENT DOCUMENTS

| | | | | |
|---|---|---|---|---|
| 6,425,462 | B1 * | 7/2002 | Tran | B66B 5/18 187/367 |
| 6,758,310 | B2 * | 7/2004 | Muff | B66B 5/20 187/370 |
| 9,457,989 | B2 * | 10/2016 | Meierhans | B66B 5/20 |
| 10,562,739 | B2 * | 2/2020 | Hu | B66B 9/00 |
| 10,889,468 | B2 * | 1/2021 | Hu | B66B 5/22 |
| 11,078,045 | B2 * | 8/2021 | Billard | B66B 5/18 |
| 11,498,803 | B2 * | 11/2022 | Koskinen | B66B 3/002 |
| 2002/0070082 | A1 * | 6/2002 | Muff | B66B 5/22 187/352 |
| 2013/0081908 | A1 * | 4/2013 | Meierhans | B66B 5/20 188/67 |
| 2016/0289045 | A1 * | 10/2016 | Osmanbasic | F16D 63/008 |

FOREIGN PATENT DOCUMENTS

| | | | | | |
|---|---|---|---|---|---|
| EP | 1205418 | A1 | | 5/2002 | |
| EP | 1213247 | A1 | | 6/2002 | |
| EP | 1902993 | B1 | | 10/2009 | |
| GB | 2314070 | A | * | 12/1997 | B66B 5/18 |
| GB | 2314070 | A | | 12/1997 | |
| GB | 2543291 | A | * | 4/2017 | B66B 5/18 |
| WO | 2005044709 | A1 | | 5/2005 | |
| WO | 2015071188 | A1 | | 5/2015 | |
| WO | 2017017488 | A1 | | 2/2017 | |

* cited by examiner

SAFETY BRAKE FOR AN ELEVATOR

FIELD

The present invention relates to a safety brake for an elevator.

BACKGROUND

In an elevator, a traveling body, in particular a car, is typically displaced vertically along a travel path between different floors or levels within a building. At least in tall buildings, an elevator type is used in which the car is held by rope or belt-like suspension means and displaced within an elevator shaft by moving the suspension means by means of a prime mover. In order to at least partially compensate for the load of the car to be moved by the prime mover, a counterweight is usually fastened to an opposite end of the suspension means. Safety brakes protect cars and often also counterweights from falling into the shaft, which could occur, for example, as a result of a suspension means breaking or a lack of drive torque from the prime mover.

Safety brakes of this kind can be triggered safely and quickly. An electronically triggered safety brake has the advantage over mechanically triggered safety brakes that the relatively complex construction of a mechanical speed limiter system can be dispensed with and that a reason for triggering the safety brake can be detected quickly by electronic sensors and on any subsystems of the elevator. Typically, the electronically triggerable safety brakes have an energy storage means, such as a spring, in order to be able to apply enough force or energy to trigger the brake if necessary. Electronically triggerable safety brakes must therefore be reset differently than conventional mechanical safety brakes, since this energy storage means must be taken into account during the resetting process.

WO 2015 071188 A1 shows a rotatably mounted guide element which, when the safety brake is activated, is first pressed against the rail by a spring force and is then pressed away from the rail again by the jamming braking element. The braking element touches the rail in the braking initial position only at certain points, since the braking element rotates together with the guide element. An additional activation element is nevertheless provided to guarantee safe engagement.

SUMMARY

One problem can be considered to be that of making triggering the safety brake safer.

According to one aspect of the invention, a safety brake for an elevator solves the problem. The safety brake comprises a first braking element, a first guide element, and an actuating element. The first braking element is displaceably mounted in a linear bearing on the first guide element. The first guide element is movable between a rest position and a braking initial position. The actuating element is designed to move the first guide element from the rest position into the braking initial position, in particular in order to activate the safety brake. The first braking element can perform a braking movement from the braking initial position into a braking position. The braking movement returns the first guide element into the rest position. The first guide element is guided on a first parallelogram guide.

According to a second aspect of the invention, an elevator having a traveling body, in particular a car, solves the problem. The traveling body moves substantially vertically along a travel path between different floors. Rails are attached along the travel path. The traveling body has a safety brake according to the first aspect of the invention, which can brake the traveling body on the rail.

The rail is preferably arranged in the elevator in such a way that at least part of the rail is arranged between the braking elements of a safety brake. In particular, the rail is arranged between the first braking element and a second braking element.

Possible features and advantages of embodiments of the invention can be considered, inter alia and without limiting the invention, to be based upon the concepts and findings described below.

In short, the safety brake comprises a first guide element on which a first braking element is linearly guided, which first braking element can be driven by an actuating element. When the safety brake is in use, the safety brake passes through the changing states of rest position, braking initial position and braking position. The states differ on account of different positions of the components of the safety brake, in particular different positions of the first guide element, the first braking element and the actuating element. The actuating element advances the guide element and the braking element guided thereon to the rail if activation of the safety braking means is indicated by a signal. The safety brake is thereby moved from the rest position into the braking initial position, in which the entire surface of a brake pad of the braking element comes into contact with the rail. The brake pad is designed to be pressed against the rail and a friction surface provided for this purpose is aligned substantially in parallel with the rail surface. Due to the contact and a relative movement between the rail and the braking element, a friction force develops between the braking element and the rail, the braking force moving the braking element further into the braking position.

The advantage that the entire surface of the braking elements is brought into contact with the rail is based on the use of parallelogram guides, which always keep the guide elements in the same orientation. The parallelogram guide substantially comprises four articulated arms, each articulated arm having two joints. The articulated arms are connected to one another at the joints in such a way that a square is formed. The mutually opposing articulated arms each have the same distance between the joints such that the square represents a parallelogram. The articulated arms are typically designed as pendulum supports, i.e. as a rod or beam which preferably has the two joints near its two ends. However, the housing or the guide element are also considered to be an articulated arm if they have two joints which are arranged and in particular spaced apart in such a way that they are suitable as an articulated arm.

Examples of the articulated arms are rods having at least two joints, and, for example, the housing, if it comprises at least two joints, corresponds to an articulated arm.

In the context of this application, a parallelogram arm is a special articulated arm of the parallelogram guide which performs a rotation when the parallelogram guide moves. The arm thus differs from the guide elements and the housings which are, relative to the housing, fastened in an immovable manner or displaced in parallel therewith. In the rest position, the parallelogram arms preferably form an angle of less than 45°, or a complementary angle of more than 135°, with the guide element. A movement of the parallelogram guide out of the rest position therefore has a significant movement component which is normal to a friction surface of the brake pad.

The braking element is guided on the guide element via a linear bearing. The linear bearing is used to guide the braking element along a straight line in the extension direction of the linear bearing. The linear bearing can be installed as a separate construction element between the braking element and the guide element, or the guide element and the braking element are designed in the contact region such that the interaction between the two contact regions results in a linear bearing. In particular guided needle bearings and roller bearings are well suited as linear bearings. Alternatively, the linear bearing can also be designed as a sliding surface. Advantageously, the extension direction of the linear bearing is slightly inclined relative to the friction surface of the brake pad, which is advantageously oriented vertically. A displacement of the braking element from the braking initial position into the braking position first pushes the guide element back into the rest position and then leads to the rail becoming jammed between the braking elements. In the braking position, which is identical to the rest position for the guide element, the guide element rests against the housing. The normal forces as a result of braking, which are transmitted by the braking element to the guide element, are introduced into the housing by the guide element. The housing is preferably designed in such a way that it counteracts the guide element at a predefined force and thereby ensures a predefined normal force on the brake pad of the braking element. Due to its construction, the housing can be designed to be yielding, or it has pretensioned springs, in particular pretensioned disk spring assemblies, which yield when the predefined force is applied.

The actuating element causes the guide element to be advanced from the rest position into the braking initial position. The actuating element preferably causes a linear or rotary movement, which is then transmitted to the guide element directly or via mechanical components such as gears, lever arms, cables, push rods or hydraulic systems. The movement can also be transmitted indirectly, as will be explained below.

The braking movement is the movement caused by the frictional connection of the braking element to the rail. This means that the relative movement of the rail relative to the braking element moves the braking element and the guide element toward the braking position via friction forces. One advantage of the safety brake is that the actuating element is brought back into a position that corresponds to the rest position by the braking movement. As a result, any spring that may be present in the actuating element is tensioned again in particular.

Another advantage of the safety brake is that the parallelogram arms absorb only very small forces. The forces acting on the parallelogram arms are only used to hold the guide element and the braking element and possibly to push back the actuating element. The large forces, such as the normal force on the braking element and the resulting friction force, which arise in the braking position on the braking element are transmitted directly to the housing by the braking element and the guide element. As described above, the normal force on the braking element is introduced into the housing via the guide element. The friction force is transmitted directly to the housing by the braking element via the brake stop. The parallelogram arms are uninvolved in both force transmissions.

According to a first alternative embodiment, the first parallelogram guide guides the first guide element on an actuating slide. According to a preferred embodiment, a second parallelogram guide guides a second guide element on the actuating slide.

In other words, the safety brake can therefore have an actuating slide which is connected to the first guide element and preferably also to the second guide element via a parallelogram guide in each case. The actuating slide can be displaced by the actuating element, which leads to the two guide elements being advanced together with their braking elements to the rail. The actuating slide is a first indirect way of transmitting the movement from the actuating element to the guide element.

A second braking element is preferably attached to the second guide element. This has the advantage that the safety brake has a braking element guided in a linear bearing on both sides of the rail. It is possible to release the elevator, i.e. to lift the traveling body out of the safety gear, with very little force, since the safety brake slides easily along the linear bearings and the braking elements do not rub against the rail during the lifting process.

According to a preferred embodiment, the actuating element displaces the actuating slide relative to the housing. According to a preferred embodiment, the actuating slide on the housing is guided in a third linear bearing.

The actuating element preferably moves the actuating slide directly. The actuating element is preferably fastened to the housing and moves the guide elements by means of an actuating mechanism. Alternatively, the actuating element can also be fastened to the guide element. In this case, the actuating mechanism is connected to the housing. In addition to being guided by the parallelogram guides, the guide elements are preferably also guided in a further guide which guides the guide elements in a direction perpendicular to the friction surface of the brake pad. The guide elements therefore each have only one possible direction of movement, and this is a linear displacement perpendicular to the friction surface of the brake pad. The guide elements therefore substantially move toward or away from the rail. The movement of the actuating slide counter to the braking movement and the additional guide brings the guide elements closer together. As a result, a distance between the friction surface of the brake pad and the rail is overcome, and the brake pad, and thus the braking element comprising the brake pad, comes into contact with the rail. The braking initial position is thus reached. The actuating slide is preferably attached centrally between the two guide elements. As a result, the two guide elements can be advanced synchronously, in particular if the actuating slide is guided centrally between the two guide elements by the third linear bearing. If the actuating slide is not guided, the guide elements can be resiliently connected to the housing so that the braking elements are kept at a sufficient distance from one another and can be advanced synchronously.

Preferably, the safety brake has only a single actuating slide and a single actuating element.

Using a third linear bearing has the advantage that the force transmission from the actuating element to the actuating slide can be made simpler. A further advantage lies in the fact that the actuating slide guided by the third linear bearing also guides the first and the second guide element in a predetermined, preferably vertical, orientation via the first and second parallelogram guides.

The third linear bearing preferably guides the actuating slide in the direction of travel in a central position. The actuating slide is held in a vertical orientation by the linear bearing. The guide elements are connected to the actuating slide via the parallelogram guide and are therefore also held in a vertical orientation.

According to a second alternative embodiment, the first parallelogram guide guides the first guide element on a housing. According to a preferred embodiment, the actuating element directly moves the first guide element.

The housing has a region that can be fastened to a traveling body by means of fastening means. In this case, bores are preferably provided so that the safety brake can be screwed to the traveling body. In particular, the housing is used to accommodate the components of the safety brake.

In other words, a safety brake according to the second alternative embodiment has a first guide element which is fastened to the housing via a parallelogram guide. In this configuration, it can be advantageous for the actuating element to act directly on the guide element.

The safety brake according to the second alternative embodiment preferably has only a first guide element. Only one stationary braking element, i.e. a braking element that is rigidly connected to the housing, is attached on the opposite side of the rail. s a result, this embodiment of the safety brake can be manufactured with less outlay, since it has only a few parts.

Alternatively, the safety brake according to the second alternative embodiment can have a stationary guide element on the side of the rail opposite the first braking element, which guide element comprises a linearly displaceable braking element. The guide element is therefore rigidly connected to the housing. The embodiment of the safety brake can be manufactured with less outlay and can also be released very easily.

The actuating element preferably has an actuating element base plate which is rigidly connected to the housing of the safety brake and is used to accommodate the components of the actuating element. The actuating element comprises an actuating mechanism in order to transmit the movement that the actuating element generates relative to the housing. The actuating mechanism moves the actuating slide or a guide element.

According to a preferred embodiment, a counter bearing stop is formed on the housing for a guide element.

The housing of the safety brake can accommodate the guide elements and is used as a counter bearing for the guide elements. The counter bearing has a counter bearing stop. In the braking position, the guide element is rigidly pressed against a counter bearing stop. In the rest position, the guide element preferably rests against the counter bearing stop. Two guide elements, each with a braking element, can be attached to opposite sides of the rail in the housing, so that the rail can be clamped between the braking elements. Alternatively, the housing may have a stationary braking element which is rigidly mounted on the housing and attached opposite the guide element and the braking element associated with the guide element. The housing is designed in such a way that it can absorb the forces that arise in the braking position. In addition, the housing is designed to be yielding in order to generate as constant a normal force as possible on the braking element for braking elements that are worn to different extents. This also ensures that the normal force and thus also the friction force remain below a maximum permissible value.

According to a preferred embodiment, the first parallelogram guide guides the first guide element on the second guide element.

In this embodiment, the second guide element can be rigidly attached to the housing. The advantage of this embodiment is that a guide element guides the braking elements on both sides of the rail. This makes it very easy to lift the safety brake out of the braking position, since the two brake pads slide easily along the relevant guide element.

According to a further embodiment, the parallelogram guide has an operable parallelogram arm which is connected to the guide element. The operable parallelogram arm can be directly operated by the actuating element.

The operable parallelogram arm preferably has a further joint, via which the actuating mechanism on the parallelogram arm transmits the movement. The transmission of the movement by means of the parallelogram arm is a further indirect transmission of the movement from the actuating element to the guide element.

According to a further embodiment, the actuating element can be activated by an electrical or electronic trigger signal.

In this case, a CAN bus can deliver a data packet, i.e. an electronic signal, to a control unit of the safety braking means, as a result of which the control unit activates a servomotor which causes the actuating element to move. In this case, the servomotor or the electromagnet and the control unit are operated with energy from an external or internal current source of the safety brake. Alternatively, the application of a voltage or current to an electrical connection, i.e. an electrical signal, can directly operate a servomotor or an electromagnet. The servomotor or the electromagnet is supplied with current directly via the electrical connection.

According to a further embodiment, the actuating element comprises an energy storage means, a holding element and an electromagnet. When energized, the electromagnet holds the holding element against the force of the energy storage means. The electrical or electronic trigger signal releases the energy storage means. In particular, the electrical or electronic trigger signal releases the energy storage means by switching off the current flow. In particular, the energy storage means is designed as a spring.

In other words, an energy storage means, typically a tensioned spring, is held by an electromagnet in such a way that it does not move. Due to the continuous current supply to the safety brake, the electromagnet can attract the holding element and thereby prevent the energy storage means from moving. As soon as the current supply to the safety brake fails, the magnetic field decreases and the electromagnet can no longer hold the holding element, and the energy storage means is released. By releasing the energy storage means, a movement is generated that is transmitted to the actuating mechanism. The electromagnet is preferably rigidly connected to the actuating element base plate. The holding element with the spring and the actuating mechanism are movably attached to the actuating element base plate. Alternatively, the holding element may be rigidly connected to the actuating element base plate, and the electromagnet with the spring and actuating mechanism are movably attached to the actuating element base plate.

Alternative energy storage means in addition to the spring are, for example, compressed-air reservoirs or clamping masses. Spring in this case can be understood to mean steel springs, elastomer springs or gas pressure springs. The springs can be installed as tension springs, compression springs or torsion springs.

According to a further embodiment, the parallelogram guide has a or the parallelogram arm which is connected to the guide element. An acute first angle between an extension direction of the parallelogram arm and a direction perpendicular to the friction surface of the brake pad in the braking initial position is greater than an acute second angle between the direction of the linear bearing on the guide element and a direction perpendicular to the friction surface of the brake pad in the braking initial position.

This ensures that a force which the first braking element transmits to the first guide element when engaging by means of the linear guide displaces the guide elements into the rest position.

According to a further embodiment, the first acute angle is at least 10° greater than the second acute angle.

Further advantages, features, and details of the invention can be found in the following description of embodiments and with reference to the drawings, in which identical or functionally identical elements are provided with identical reference signs. The drawings are merely schematic and are not to scale.

DETAILED DESCRIPTION

Figure 1A:
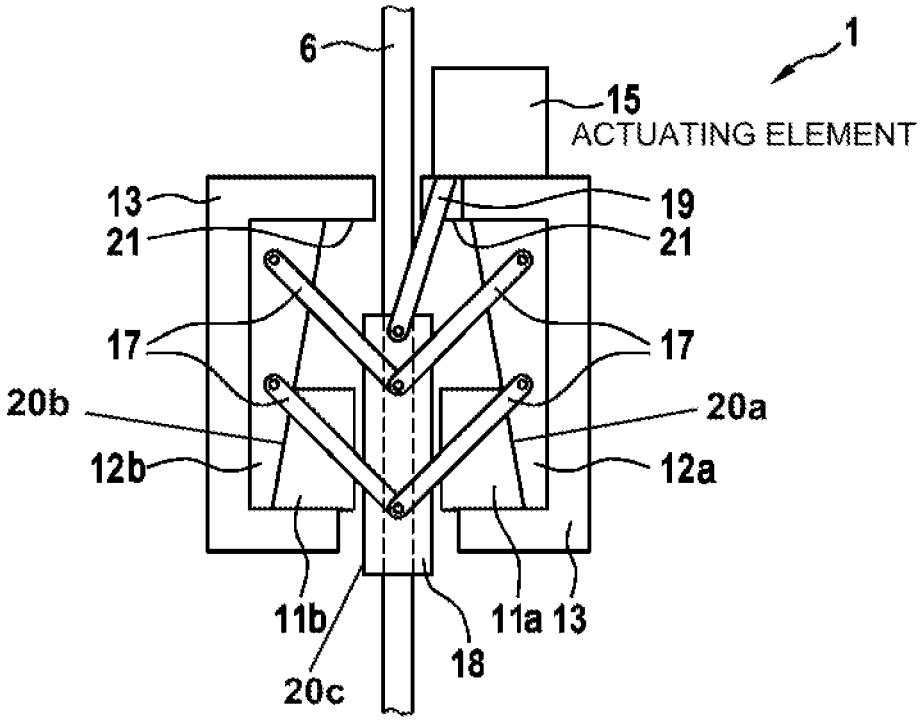
FIG. 1*a* is a safety brake according to the first alternative embodiment in the rest position.
Figure 1B:
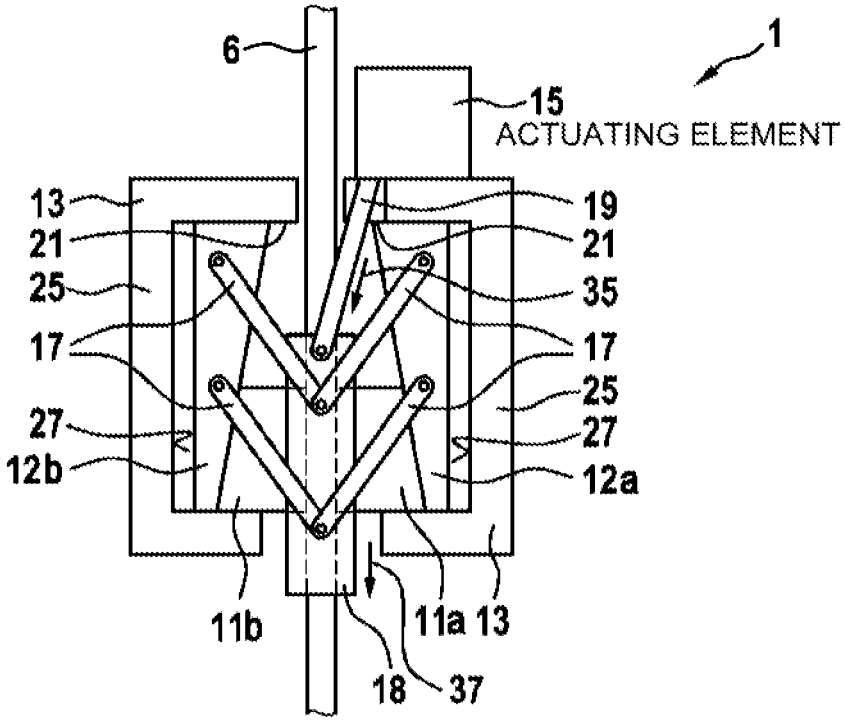
FIG. 1*b* is a safety brake according to the first alternative embodiment in the braking initial position.
Figure 1C:
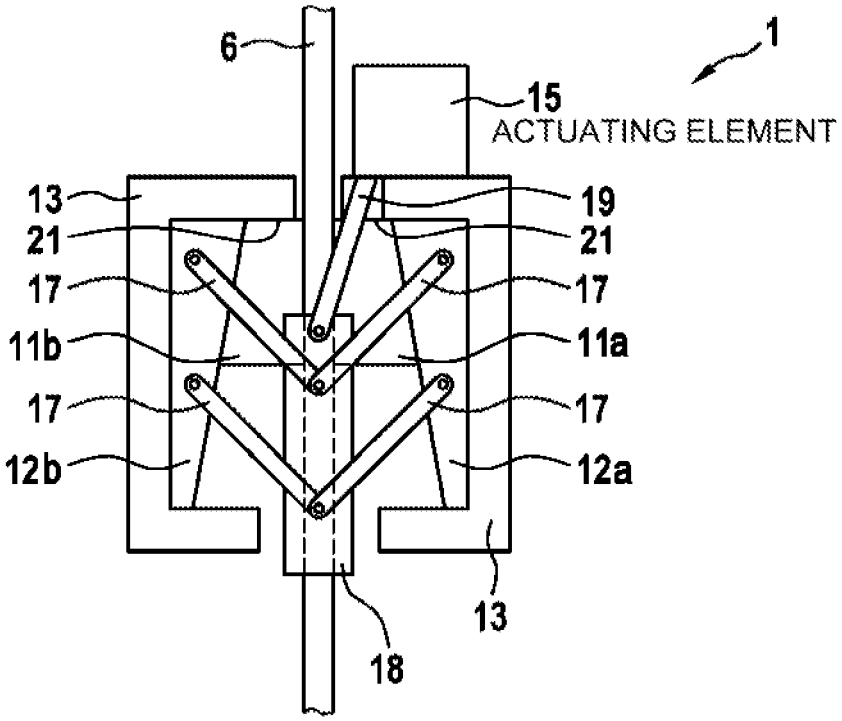
FIG. 1*c* is a safety brake according to the first alternative embodiment in the braking position.

FIGS. 1*a* to 1*c* show a safety brake 1 according to the first alternative embodiment. The safety brake 1 is designed to clamp a rail 6 if necessary, and thereby achieve a braking effect.

In the rest position, shown in FIG. 1*a*, the actuating mechanism 19, which is a sub-component of the actuating element 15, holds the actuating slide 18. In the rest position, the two guide elements 12*a*, 12*b* are spaced apart from one another, so that the braking elements 11*a*, 11*b* guided on the guide elements 12*a*, 12*b* are spaced sufficiently far apart from the rail 6. The braking elements 11*a*, 11*b* are guided in first and second linear bearings 20*a*, 20*b* respectively. The guide elements 12*a*, 12*b* rest against the counter bearing stops 27 of the counter bearing 25. The counter bearings 25 are part of the housing 13. The parallelogram arms 17 connect the two guide elements 12*a*, 12*b* to the actuating slide 18. The actuating slide 18 is guided on the housing 13 by a third linear bearing 20*c*.

In order to activate the safety brake 1, the actuating element 15 is prompted via a signal to displace the actuating mechanism 19 in the triggering direction 35, and thereby to displace the actuating slide 18 in the direction of the triggering movement 37. As a result, the braking initial position, as shown in FIG. 1*b*, is reached. Since the guide elements 12*a*, 12*b* can only be displaced perpendicularly relative to the direction of the triggering movement 37, the guide elements move closer to one another and away from the relevant counter bearing stop 27. As soon as the braking elements 11*a*, 11*b* are pressed against the rail 6 with a sufficiently large normal force, the brake elements move along the guide elements 12*a*, 12*b* in the direction of the braking position, as shown in FIG. 1*c*. The guide elements 12*a*, 12*b* are pushed away from the rail 6 by the wedge shape of the guide elements 12*a*, 12*b* and the braking elements 11*a*, 11*b*. The guide elements 12*a*, 12*b* are pressed up to the counter bearing stops 27. As soon as the counter bearing stops 27 are touched, further movement of the braking elements 11*a*, 11*b* causes a sharp increase in the normal force on the braking elements 11*a*, 11*b*. The braking elements 11*a*, 11*b* are further displaced until they reach the two brake stops 21. The housing 13 of the safety braking means is designed in such a way that the counter bearing stops 27 yield slightly under the load of the normal forces, thereby keeping a required normal force substantially constant, even if the braking elements 11*a*, 11*b* are worn down during the braking process or over multiple braking processes.

The braking position is shown in FIG. 1*c*. The advantage of the invention is shown by the fact that the actuating mechanism 19 and thus also the actuating element 15 are also displaced as a result of the movement from the braking initial position into the braking position. In the braking position, the actuating mechanism 19 and thus also the actuating element 15 are again in the same position as in the original rest position. In particular, the energy storage means in the actuating element 15 is also tensioned again. No further supply of energy is necessary in order to tension the energy storage means in the actuating element 15 again.

Figure 2A:
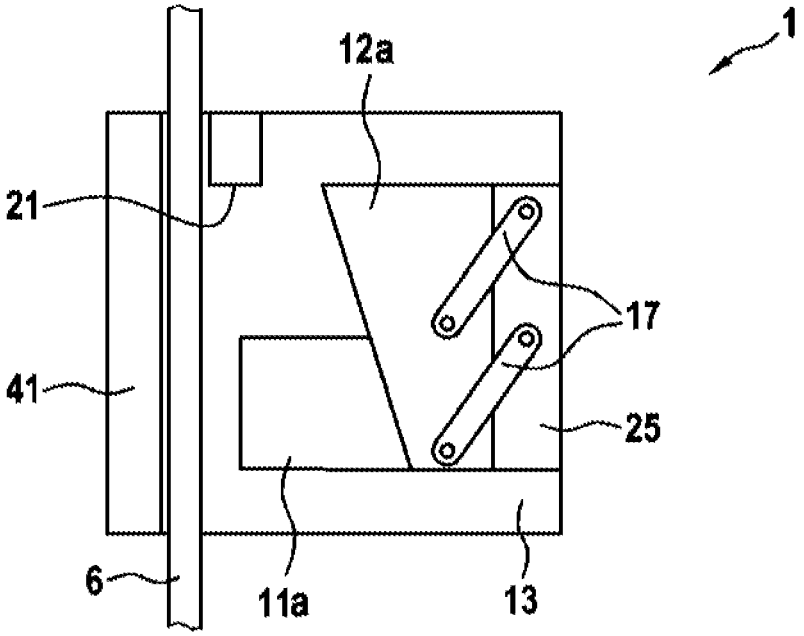
FIG. 2*a* is a safety brake according to the second alternative embodiment in the rest position.
Figure 2B:
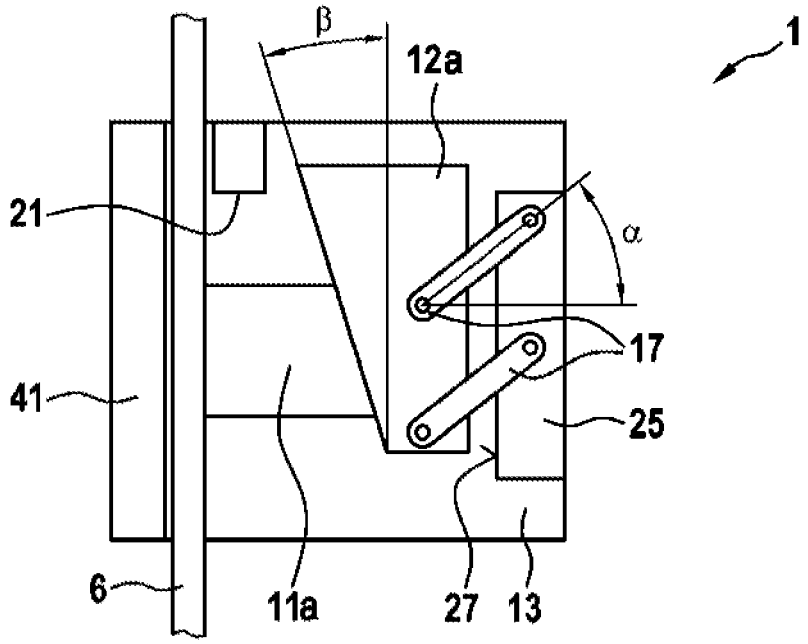
FIG. 2*b* is a safety brake according to the second alternative embodiment in the braking initial position.
Figure 2C:
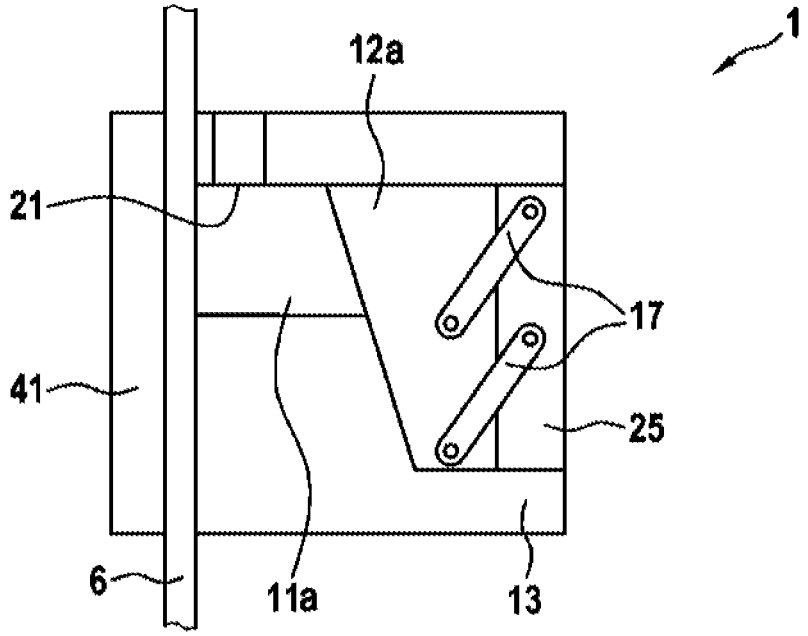
FIG. 2*c* is a safety brake according to the second alternative embodiment in the braking position.
Figure 4:
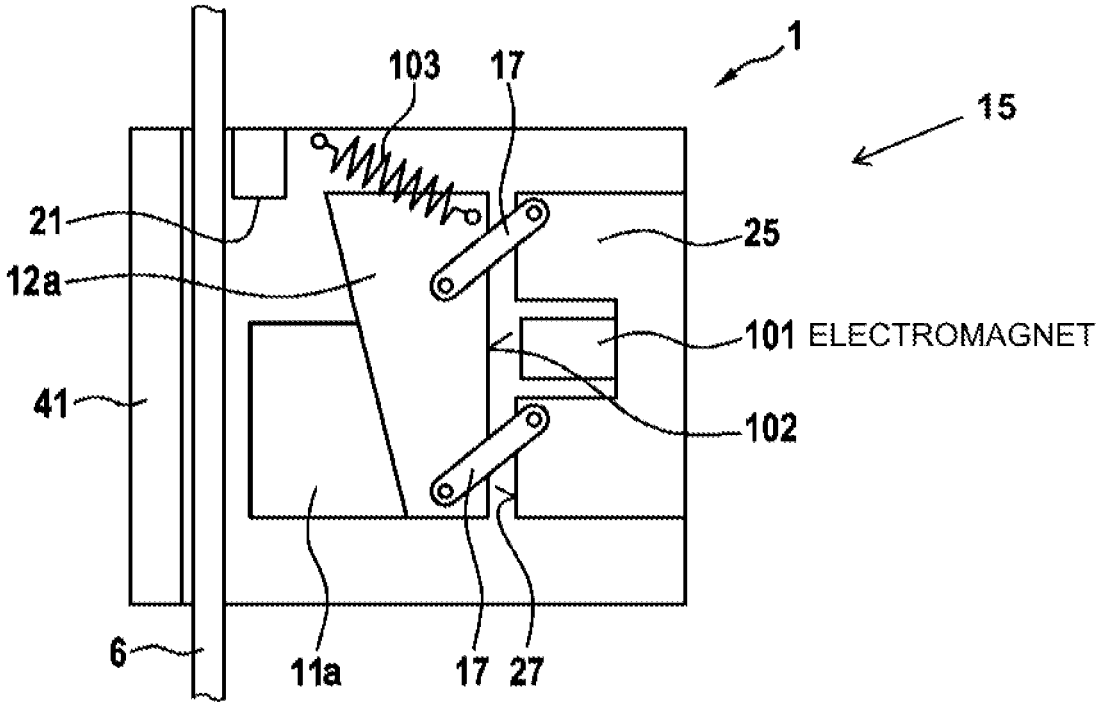
FIG. 4 is a safety brake having an actuating element which is partially integrated into the counter stop.
Figure 5:
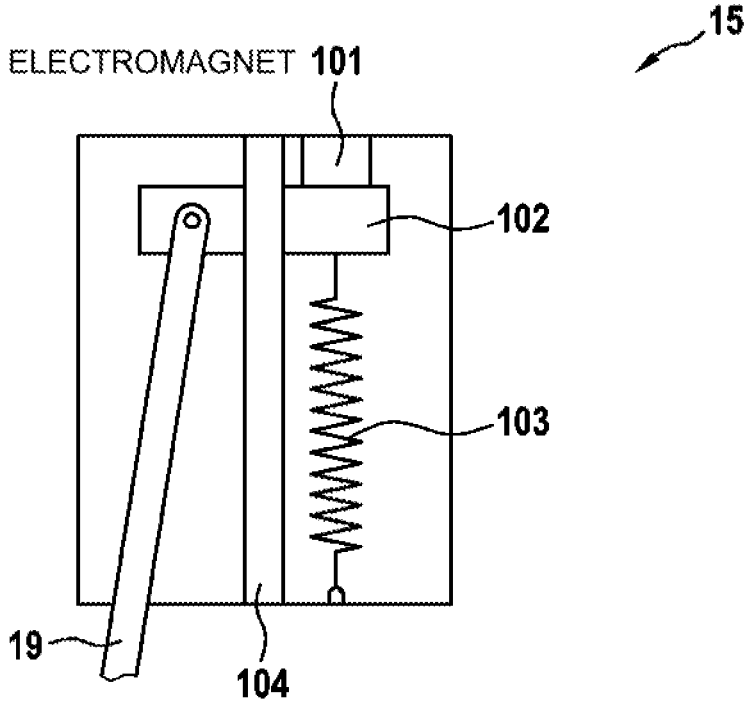
FIG. 5 is an actuating element, as a modular component.

FIGS. 2*a* to 2*c* show a safety brake 1 according to the second alternative embodiment. The basic functionality is the same as in the first alternative embodiment. The actuating element 15 is not shown in FIGS. 2*a* to 2*c*. Possible configurations for a suitable actuating element 15 are shown in FIGS. 3, 4 and 5.

FIG. 2*a* shows the rest position of the safety brake 1. In order to be transferred into the braking initial position, as shown in FIG. 2*b*, the guide element 12*a* is moved into the braking initial position by the actuating element (not shown). As soon as the braking element 11*a* is pressed against the rail 6 with a sufficiently large normal force, it moves along the guide element 12*a* in the direction of the braking position. As a result, the braking element 11*a* of the safety brake 1 presses so hard on the rail 6 that the safety brake 1, together with the entire traveling body, is displaced laterally until the stationary braking element 41 also touches the rail 6. In addition, the guide element 12*a* is displaced up to the counter bearing stop 27 of the counter bearing 25. The counter bearing 25 is rigidly connected to the housing 13. As soon as the counter bearing stop 27 is touched, a further movement of the braking element 11*a* causes a sharp increase in the normal force on the braking element 11*a*. The braking element 11*a* is further displaced until it reaches the brake stop 21. The housing 13 of the safety braking means is designed in such a way that the counter bearing stop 27 and the stationary braking element 41 yield slightly under the load of the normal forces, thereby keeping a required normal force substantially constant, even if the braking elements 11*a*, 41 were worn down during the braking process or over multiple braking processes.

FIG. 2*b* shows an example of a first angle $\alpha$ and a second angle $\beta$. The force that is transmitted on the linear bearing between the guide element 12*a* and the braking element 11*a* acts perpendicularly relative to the direction of the linear bearing, since the linear bearing is substantially frictionless. Because the first angle $\alpha$ is greater than the second angle $\beta$, it is ensured that the force that is transmitted on the linear bearing between the guide element 12*a* and the braking element 11*a* presses on the guide element 12*a* at an angle, so that the guide element 12*a*, which is mounted by the parallelogram, is pressed back in the direction of the rest position.

Figure 3:
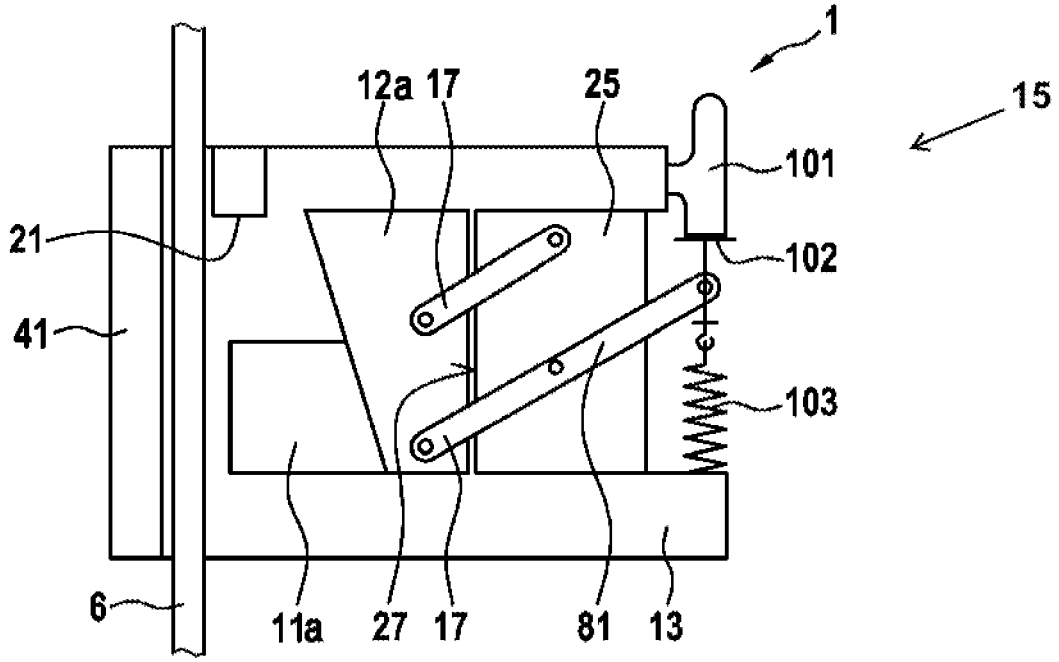
FIG. 3 is a safety brake having an operable parallelogram arm.

FIG. 3 shows a safety brake 1 according to the second alternative embodiment, with a first embodiment of the actuating element 15. In this case, the actuating element acts on an operable parallelogram arm 81. The operable parallelogram arm 81 is elongate compared to a conventional parallelogram arm 17 which is just long enough to connect the two joints. An electromagnet 101 is designed to hold a holding element 102. The holding element 102 is placed under tensile stress by a spring 103. The spring 103 is therefore a tension spring. In order to trigger the safety braking means, the current supply to the electromagnet 101 is interrupted as a trigger signal. The holding element 102 detaches from the electromagnet 101, and the spring 103 moves the guide element 12*a* into the braking initial position by means of the operable parallelogram arm 81. In the braking position, the guide element 12*a* is then again in contact with the counter bearing stop 27 of the counter bearing 25. As a result, the operable parallelogram arm 81 and the holding element 102 are also in the same position as in the original rest position. The electromagnet 101 thus holds the holding element 102 again as soon as it is supplied with current again.

FIG. 4 shows a safety brake 1 according to the second alternative embodiment, with a second embodiment of the actuating element 15. The electromagnet 101 is designed to hold the holding element 102. In this case, the holding element 102 is formed on the guide element 12*a*. The guide element 12*a* is placed under tensile stress by the spring 103. The spring 103 is therefore a tension spring. Alternatively, a spring could be attached around the electromagnet 101; such a spring would then act as a compression spring. In order to trigger the safety braking means, the current supply to the electromagnet 101 is interrupted as a trigger signal. The holding element 102 detaches from the electromagnet 101, and the spring 103 moves the guide element 12*a* into the braking initial position. In the braking position, the guide element 12*a* is then again in contact with the counter bearing stop 27 of the counter bearing 25. As a result, the holding element 102 is also in the same position as in the original rest position. The electromagnet 101 thus holds the holding element 102 again as soon as it is supplied with current again.

FIG. 5 shows an actuating element 15 which can be easily replaced as a modular component for a safety brake 1 if necessary. In particular, this actuating element 15 is suitable for use in the safety brake 1 according to the first alternative embodiment, as shown in FIGS. 1*a* to 1*c*. This actuating element 15 is also suitable for use in the safety brake 1 according to the second alternative embodiment, as shown in FIGS. 2*a* to 2*c*. The electromagnet 101 is designed to hold the holding element 102. The electromagnet 101 is fastened to the actuating element 15, and the holding element 102 is movably mounted together with the actuating mechanism 19. Alternatively, the holding element 102 could also be fastened to the actuating element 15, and the electromagnet 101 could be movably mounted on the actuating element guide 104 together with the actuating mechanism 19. The guide element 12*a* is placed under tensile stress by the spring 103. The spring 103 is therefore a tension spring. In order to trigger the safety braking means, the current supply to the electromagnet 101 is interrupted as a trigger signal. The holding element 102 detaches from the electromagnet 101 and the spring 103 moves the actuating mechanism 19. By reaching the braking position, the actuating mechanism 19 is moved back again, so that the electromagnet 101 can hold the holding element 102 as soon as it is supplied with current again.

Figure 6:
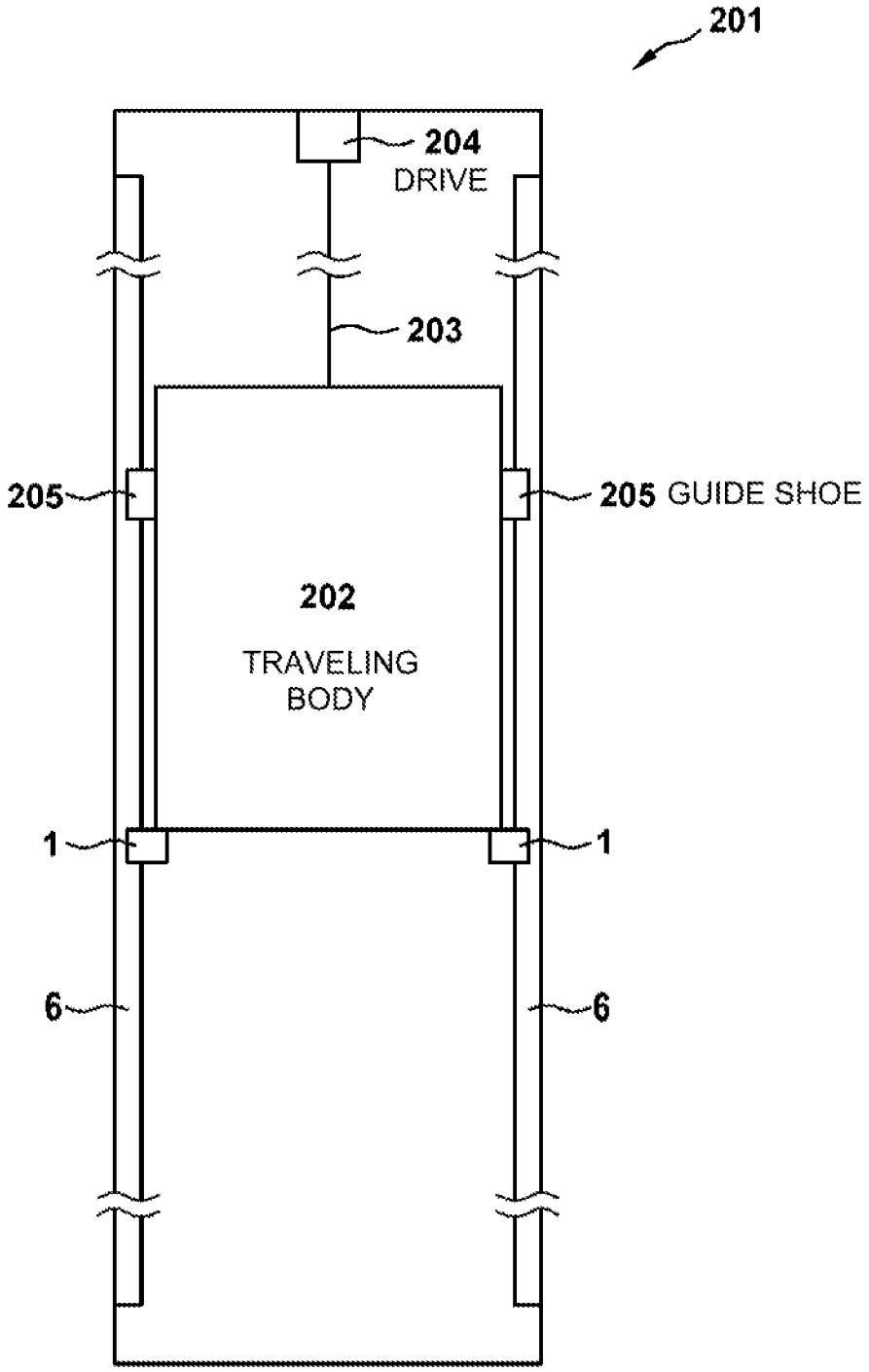
FIG. 6 is an elevator having safety brakes.

FIG. 6 shows an elevator 201 having a traveling body 202. By means of a drive 204, to which the traveling body 202 is connected to a suspension means 203, the traveling body 202 is displaced along a travel path. Rails 6 are attached along the travel path. The traveling body is guided by guide shoes 205 on the rails. The two safety brakes 1 are designed to be able to brake the traveling body 202 on the rails 6.

Finally, it should be noted that terms such as "comprising," "having," etc., do not preclude other elements or steps and terms such as "a" or "an" do not preclude a plurality. Furthermore, it should be noted that features or steps which have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety brake for an elevator, the safety brake comprising:

a first braking element;

a first guide element;

an actuating element;

wherein the first braking element is displaceably mounted in a linear bearing on the first guide element, the first guide element being movable between a rest position and a braking initial position;

wherein the actuating element moves the first guide element from the rest position into the braking initial position to activate the safety brake, the first braking element then performing a braking movement from the braking initial position into a braking position, and the braking movement returning the first guide element into the rest position; and wherein the first guide element is guided during the movement between the rest position and the braking initial position on a first parallelogram guide.

2. The safety brake according to claim 1 wherein the first parallelogram guide guides the first guide element on an actuating slide.

3. The safety brake according to claim 2 including a second parallelogram guide that guides a second guide element on the actuating slide.

4. The safety brake according to claim 2 wherein the actuating element displaces the actuating slide relative to a housing that accommodates the first braking element, the first guide element, the actuating element and the first parallelogram guide.

5. The safety brake according to claim 2 wherein the actuating slide is guided on the housing in another linear bearing.

6. The safety brake according to claim 1 wherein the first parallelogram guide guides the first guide element on a housing.

7. The safety brake according to claim 1 wherein the actuating element moves the first guide element by a parallelogram arm connected between the actuating element and the first guide element.

8. The safety brake according to claim 1 including a counter bearing stop formed on a housing for the first guide element.

9. The safety brake according to claim 1 wherein the first parallelogram guide has an operable parallelogram arm connected to the first guide element and the operable parallelogram arm is operated by the actuating element to move the first guide element.

10. The safety brake according to claim 1 wherein the actuating element is activated by an electrical trigger signal or electronic trigger signal.

11. The safety brake according to claim 10 wherein the actuating element includes an energy storage means, a holding element and an electromagnet, the electromagnet holding the holding element against a force generated by the energy storage means when the electromagnet is energized, and the electromagnet releasing the energy storage means in response to the trigger signal by switching off a current flow to the electromagnet.

12. The safety brake according to claim 11 wherein the energy storage means is a spring.

13. The safety brake according to claim 1 wherein the first parallelogram guide has a parallelogram arm connected to the first guide element, and wherein an acute first angle between an extension direction of the parallelogram arm and a direction perpendicular to a friction surface of the first braking element in the braking initial position is greater than an acute second angle between a direction of the linear bearing on the first guide element and a direction perpendicular to the friction surface of the first braking element in the braking initial position.

14. The safety brake according to claim 13 wherein the first acute angle is at least 10° greater than the second acute angle.

15. An elevator comprising:

a car movable along a travel path between different floors;

a rail attached along the travel path for guiding the car; and the safety brake according to claim 1 attached to the car for braking the car on the rail.

16. A safety brake for an elevator, the safety brake comprising:

a first braking element and a second braking element;

a first guide element and a second guide element;

an actuating slide;

a first parallelogram guide connecting the first guide element to the actuating slide;

a second parallelogram guide connecting the second guide element to the actuating slide;

an actuating element connected to the actuating slide;

wherein the first and second braking elements are displaceably mounted in linear bearings on the first and second guide elements respectively, the first and second guide elements being movable between a rest position and a braking initial position; and wherein the actuating element moves the actuating slide and the first and second parallelogram guides to move the first and second guide elements from the rest position into the braking initial position to activate the safety brake, the first and second braking elements then performing a braking movement from the braking initial position into a braking position, and the braking movement returning the first and second guide elements into the rest position.

17. The safety brake according to claim 16 wherein the actuating element is connected to the actuating slide by an actuating mechanism.

* * * * *